US005937583A

United States Patent [19]

Lamperti

[11] Patent Number: 5,937,583

[45] Date of Patent: Aug. 17, 1999

[54] DEVICE FOR CLOSING ROAD WELLS IN VEHICLE AND PEDESTRIAN AREAS

[76] Inventor: Riccardo Lamperti, Via Melchiorre Gioia, 75 - Milano, Italy

[21] Appl. No.: 08/961,993

[22] Filed: Oct. 31, 1997

[51] Int. Cl.[6] ..... E05F 1/10

[52] U.S. Cl. ..... 49/386; 16/298; 16/306

[58] Field of Search ..... 49/386, 387; 16/306, 16/307, 298, 299, 300, 304, 305

[56] References Cited

U.S. PATENT DOCUMENTS

| | | | |
|---|---|---|---|
| 1,801,840 | 4/1931 | Banfield | 49/386 X |
| 2,183,210 | 12/1939 | Anderson | 16/306 X |
| 3,810,275 | 5/1974 | Smith | 16/306 X |
| 5,142,738 | 9/1992 | Ojima | 16/306 |
| 5,240,319 | 8/1993 | Koga | 16/306 X |
| 5,465,862 | 11/1995 | Devlin | 16/306 X |

*Primary Examiner*—Jerry Redman

*Attorney, Agent, or Firm*—Robert F. I. Conte; Lee, Mann, Smith, McWilliams, Sweeney & Ohlson

[57] ABSTRACT

A device for closing road wells in vehicle and pedestrian zones is provided, said device comprising a support frame (2) defining an access opening (4) and a plate closing element (5) rotatably engaged with the support frame (2) about a hinging axis (6) so as to be movable between a raised open position and a lowered closed position.

19 Claims, 7 Drawing Sheets

DEVICE FOR CLOSING ROAD WELLS IN VEHICLE AND PEDESTRIAN AREAS

FIELD AND BACKGROUND OF THE INVENTION

The present invention relates to a device for closing road wells in vehicle and pedestrian areas. It is known that devices for closing road wells formed underneath road surfaces or open areas and intended for the most varied uses, for example for housing the valves and connection nozzles of tanks or cisterns, generally comprise a support frame stably fixed to the ground with cement mortar or other similar materials and defining an opening for access to the underlying cavity, and a plate element matching the edge of said access opening so as to close the latter with its own weight.

The plate element normally consists of a considerable mass of grey iron, for example of about 90 to 100 kg, in all cases in which said plate element and the corresponding access opening are, for functional reasons, of large sizes. In fact, the plate element must have a thickness suitable for withstanding stresses and weights even of a significant nature, such as those imparted by vehicles which may pass on it, without undergoing substantial flexural deformations or being displaced from its seat.

Opening a device for closing road wells of the type briefly described above involves carrying out a fairly difficult and physically tiring operation since two persons are required for simultaneously exerting a raising force by means of suitable tools or special spanners which can be inserted into and rotated inside appropriate holes formed in the plate element.

The latter, once it has been raised and separated from the support frame, is placed alongside the access opening. A similar operation must be performed when the plate element is to be rearranged to the closed position.

It is obvious, therefore, that the cast-iron plate elements of the known type, in particular when frequent opening and closing operations must be performed, in addition to not being very practical for use owing to the necessary presence of two persons, also offer a limited degree of safety, since the manual displacement of a metal mass of considerable weight may easily cause damage and injury to the involved workers.

It has already been attempted to overcome the abovementioned drawbacks by constructing the plate elements using cast iron with improved mechanical strength characteristics, such as nodular cast iron, so as to be able to reduce their mass and hence the effort required for the opening and closing operations.

However, this known technical solution, in addition to involving in any case an operation which can be performed only by at least two persons, has proved not only to have a high cost owing to the improved qualities of the material used, but also not to be entirely functional. In fact, since these plate elements have a limited thickness and hence also a considerably smaller mass, for the same admissible load levels as those of plate elements made of grey iron, they may be more easily deformed or dislodged from the seat inside which they rest only with their weight, owing to the repeated thrust forces which are normally imparted to them by vehicles.

SUMMARY OF THE INVENTION

Under this situation, the general object of the present invention is to provide a device for closing road wells in vehicle and pedestrian areas, which is able to substantially overcome the mentioned drawbacks.

Within the scope of said general object it is an important object of the present invention to provide a closing device which can be simply and easily manoeuvred even by a single person and which allows one to perform, with a minimum amount of effort and in complete safety, repeated opening and closing operations, including removal of the cover when this is required.

It is a further object of the invention to provide a closing device capable of operating with great reliability, that is without any risk of undesired openings occurring under any operating conditions. The objects specified are substantially achieved by a device for closing road wells in vehicle and pedestrian areas according to the features set forth in the appended claims.

BRIEF DESCRIPTION OF THE DRAWINGS

The description of a preferred embodiment of a closing device according to the invention is now provided by way of non-limiting example and illustrated in the accompanying drawings in which.

DESCRIPTION OF THE PREFERRED EMBODIMENT

Figure 1:
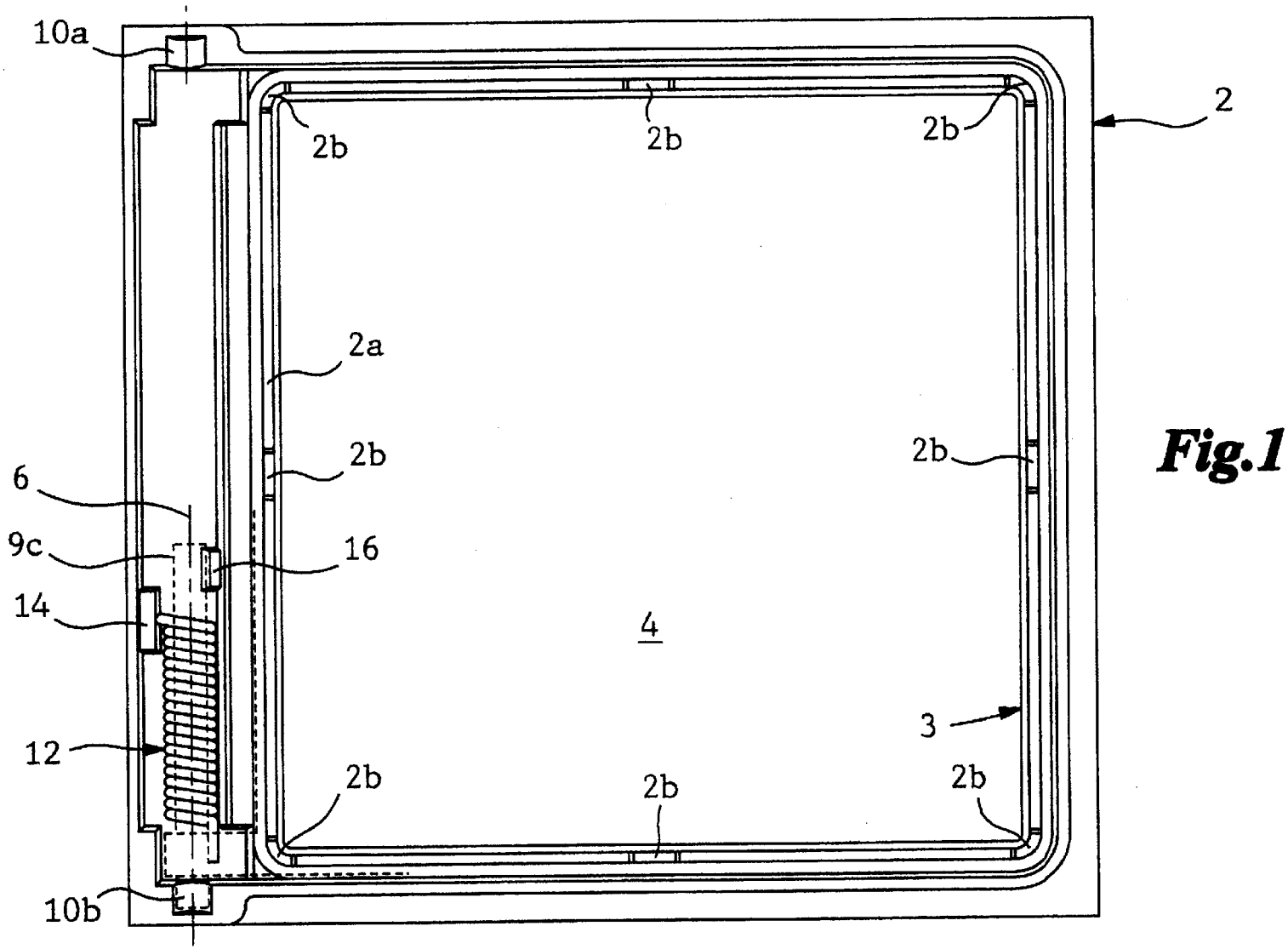
FIG. 1 shows a view from above of a frame forming part of the closing device according to the invention.

With reference to the figures mentioned, 1 generally denotes a device for closing road wells in vehicle and pedestrian areas.

It comprises a support frame 2, for example of substantially quadrangular shape, having an internal edge 3 defining an opening 4 for access to a well or to a cavity of any type.

The support frame 2 has a plate element 5 rotatably engaged with it along a hinging axis 6.

Figure 2:
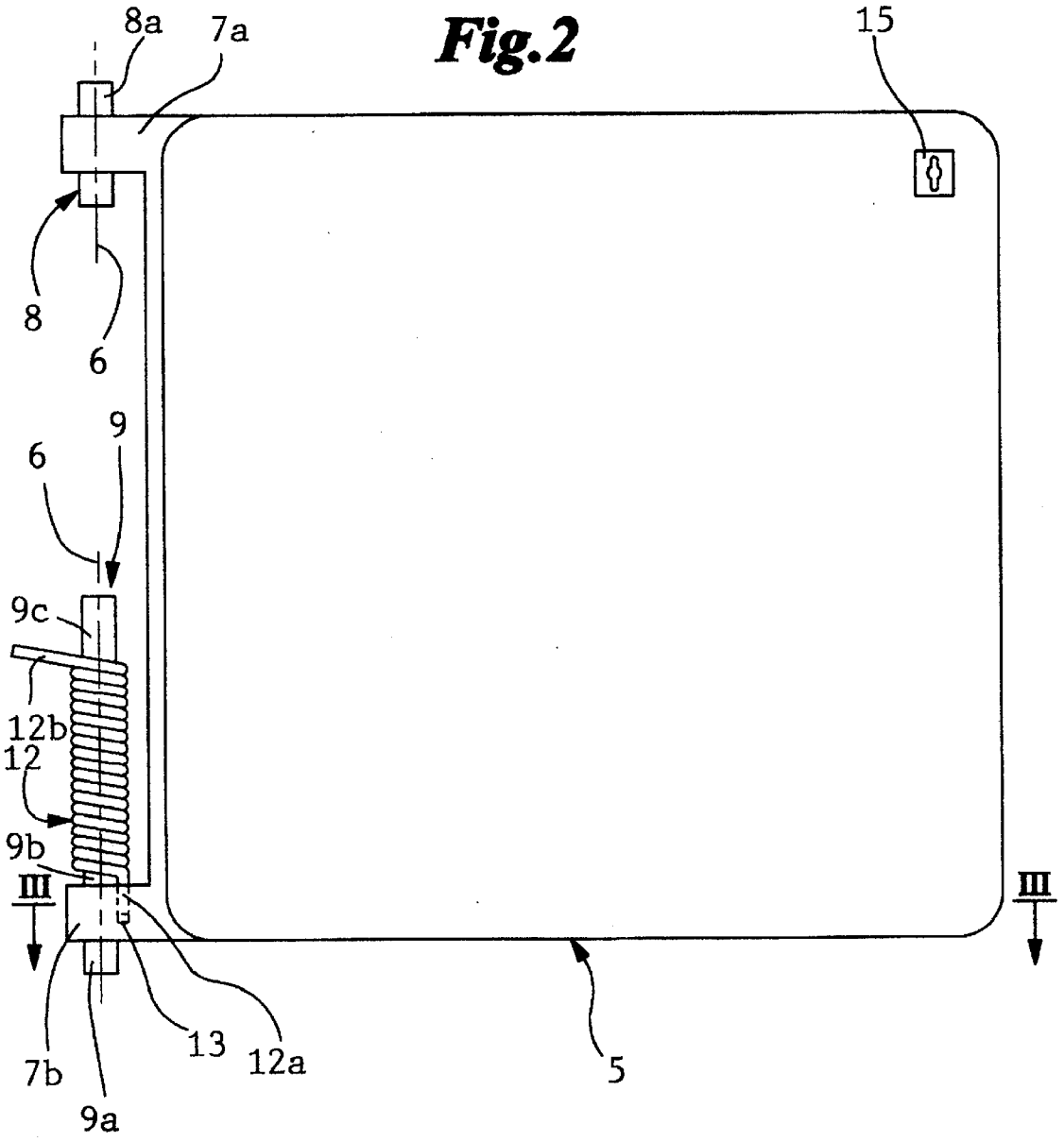
FIG. 2 shows, in plan view, a plate element which can be coupled to the frame according to FIG. 1.
Figure 3:
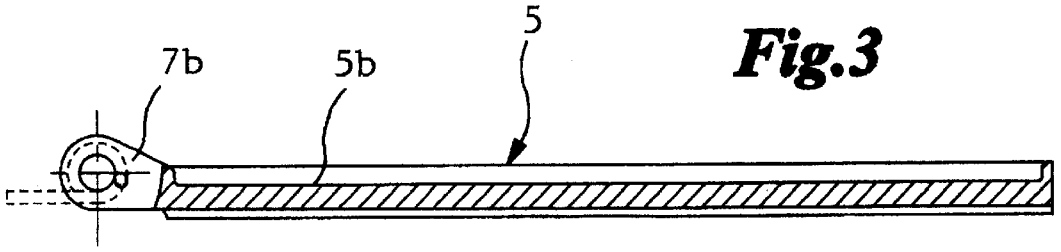
FIG. 3 shows a section along the plane III—III according to FIG. 2.

In a first embodiment, the plate element 5 can peripherally be provided, at the end of one side thereof, with a pair of lug-like projections comprising a first projection 7*a* and a second projection 7*b* respectively engaging with a first hinge pin 8 of smaller length and a second hinge pin 9 of greater length, said pins being aligned along a hinging axis 6 (see FIGS. 1 and 2, for example).

The first pin 8 comprises an active end zone 8*a* which can be inserted into a first housing recess 10*a* formed in the frame 2, and the second pin 9 comprises a first end attachment zone 9*a* which can be engaged with a second housing recess 10*b* provided in the frame 2 and aligned with the first recess 10*a* along the hinging axis 6.

Moreover, the plate element 5 has a perimetral shoulder 5*a* at the bottom, which shoulder can be inserted into a correspondingly shaped cavity 2*a* of frame 2 inside which a sealing gasket 11 consisting of compressible material is arranged. The perimetral shoulder 5*a* has, adjacent to it, an abutting edge 5*b* which can rest, in the closed position, against upwardly projecting support zones 2*b* of frame 2.

The perimetral shoulder 5*a*, correspondingly shaped cavity 2*a* and support zones 2*b* have suitable dimensions so that the sealing gasket 11 is adequately compressed when the abutting edge 5*b* is in contact with the support zones 2*b*.

At least one torsional spring 12 is advantageously arranged between the plate element 5 and the support frame 2. The torsional spring 12 is of the helical type and comprises a first end portion 12*a*, inserted into a fastening seat 13 defined by a recess formed in the second projection 7*b*, and a second end portion 12*b* which is locked against the frame 2 via a stop element or abutment surface 14.

The torsional spring 12 is arranged in winding relationship onto an intermediate portion 9*b* of the second pin 9 extending in cantilevered fashion away from the second projection 7*b*, and therefore has a working axis substantially coinciding with the hinging axis 6. Furthermore, the torsional spring 12 is designed and suitably arranged so as to be tensioned when the plate element is in the closed position (see FIG. 6) and released when the plate element is in the raised, i.e. open position (see FIG. 4).

In the closed position the torsional spring 12 is arranged so as to exert a raising force at least slightly lower than the weight of the plate element 5, so that the well remains per se closed. Moreover, for safety reasons, the plate element 5 is retained by means of one or two locking elements 15, for example of the bolt, bayonet or other types (FIG. 2).

The second hinge pin 9 comprises, in addition to the intermediate zone 9*b*, a second free end zone 9*c* arranged in contact with an abutment block 16 integral with the support frame 2 and designed to withstand the flexural thrust forces exerted on the second pin 9 by the torsional spring 12.

The abutment block 16 and the free end zone 9*c* advantageously define angular stop means for the plate element 5. Practically, the free zone 9*c*, pushed against the block 16, generates a friction capable of holding the plate element locked at any angular position thereof.

Advantageously, at least one rotation-stopping element is provided which is operatively associated with frame 2 and defines a locator active on the plate element 5 in a raised position relative to the hinging axis 6 and operating at the rear, away from the plate element 5.

Figure 7:
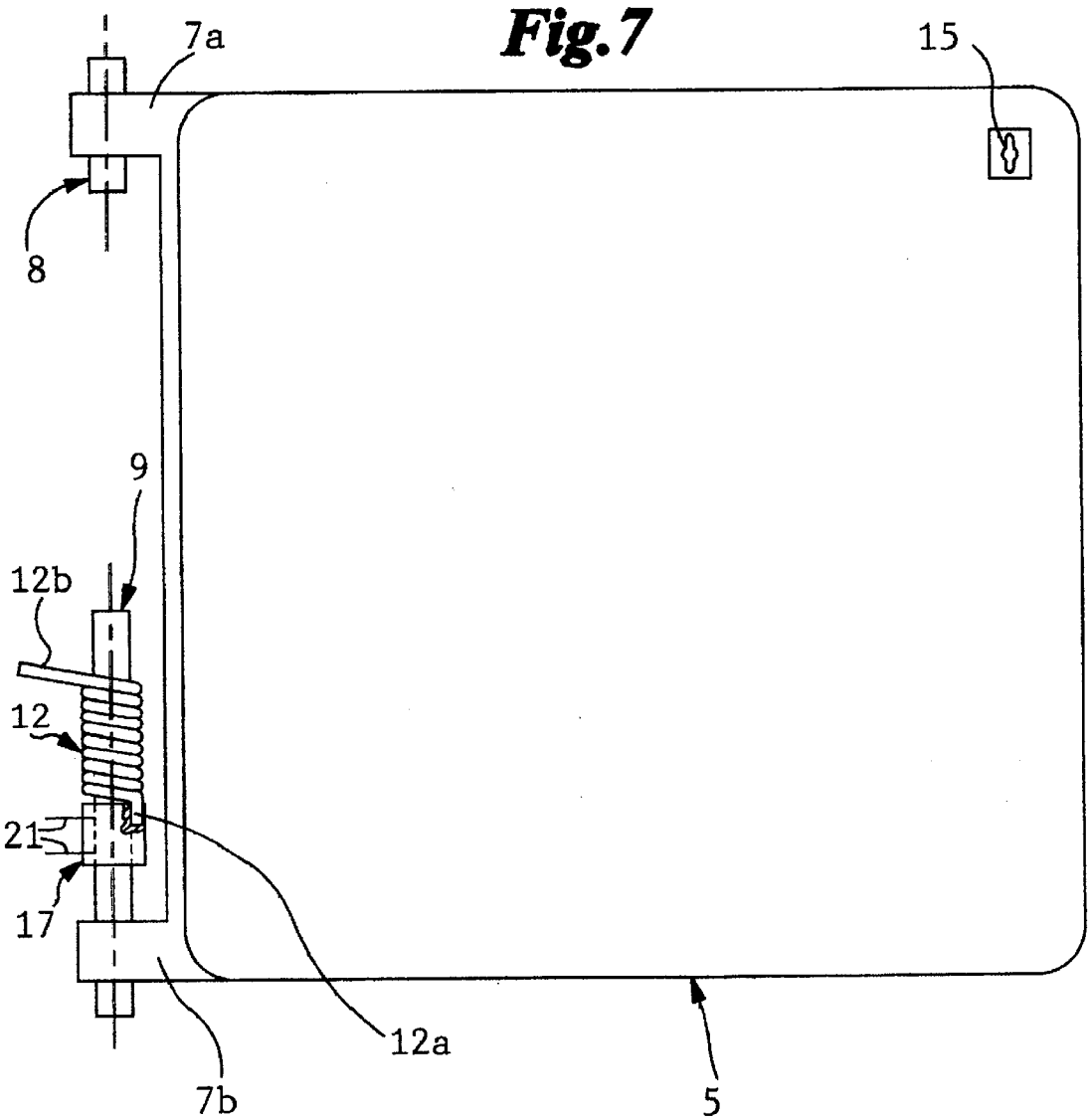
FIG. 7 shows, in plan view, a constructional variant incorporating an element for adjusting the torsional pretensioning force of the spring associated with the plate-like closing element.
Figure 9:
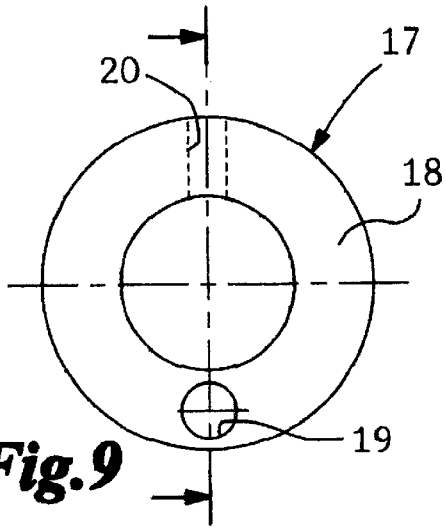
FIG. 9 is a side view of the adjusting element according to FIG. 1.
Figure 8:
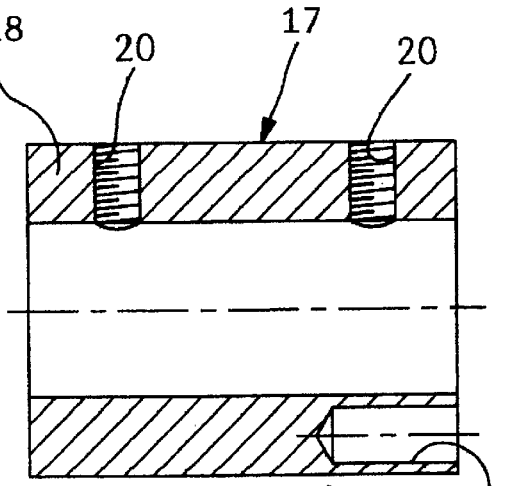
FIG. 8 shows a longitudinally sectioned view of said adjusting element.
Figure 11:
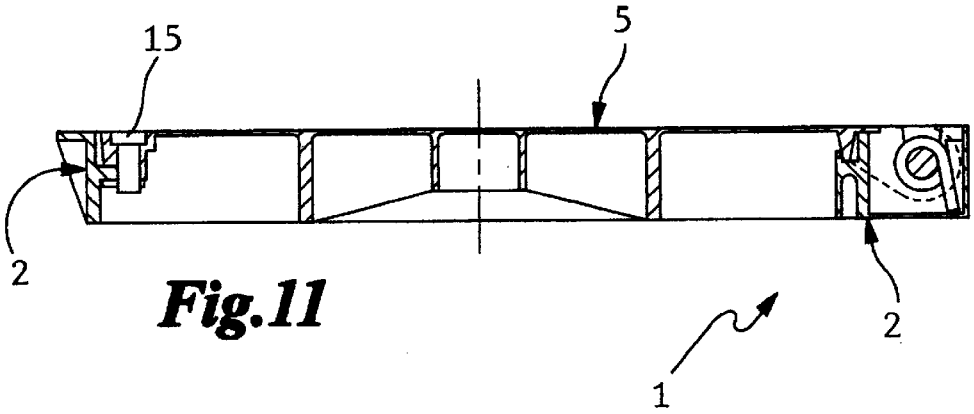
FIG. 11 is a sectional view taken along line XI—XI in FIG. 10.
Figure 17:
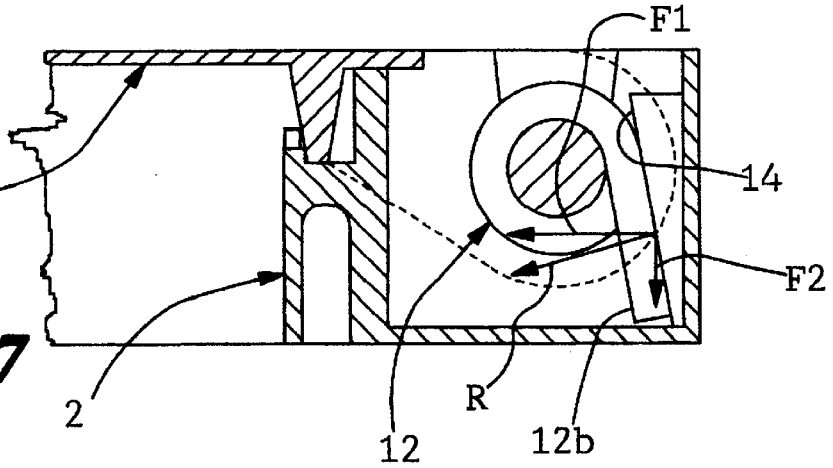
FIG. 17 is a detailed view of an end portion of the spring associated with the plate element.
Figure 13:
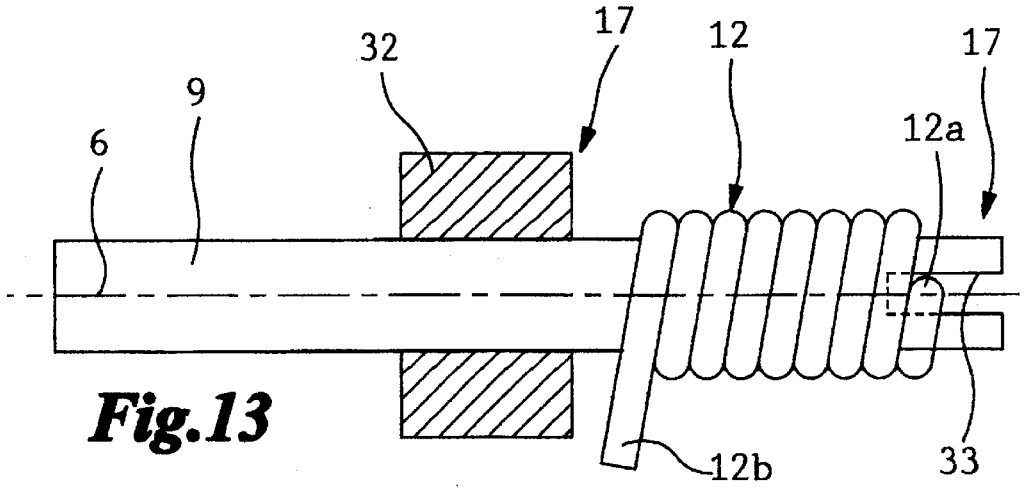
FIG. 13 is a sectional view taken along line XIII—XIII of FIG. 12.

With reference to FIGS. 7 to 9 and in accordance with a constructional variant of the invention, the first end portion 12*a* of spring 12 is provided to be in engagement with the hinge pin 9 to transmit a predetermined torque or twisting moment to said pin. At least in this case therefore pin 9, in addition to being a hinge pin, is also a driving pin as it receives the torsional spring action. The second end 12*b* of the helical spring still acts in abutment against an abutment surface 14 integral with frame 2 and preferably such shaped that on the second end it defines a constraining reaction R having a horizontal component F1 and a vertical component F2 directed downwardly (FIG. 17).

Device 1 is provided with an element 17 for adjusting the torsional pretensioning force of the torsional spring 12. This adjusting element may substantially consist of a tubular body 18 (FIGS. 8 and 9) which, prior to positioning of the plate element 5 onto the access opening 4 of the manhole cover, is fitted onto the second hinge pin 9. The tubular body 18 is provided with a seating 19 into which the first end portion 12*a* of the torsional spring 12 engages, which spring is then fitted onto said second hinge pin 9. The tubular body 18 is further provided with at least one threaded transverse hole 20 inside which at least one setscrew 21 shown in FIG. 7 by its respective axis engages, for locking said tubular body 18 on the second hinge pin 9.

Once the tubular element 18 has been mounted with the torsional spring 12 on the second hinge pin 9, adjustment of the pretensioning force on the spring is obtained by rotating the tubular element and spring on the second hinge pin 9 so that the second end portion 12*b* is arranged at a predetermined angle with respect to said second hinge pin 9. When the plate-like covering element 5 is inserted into the housing recesses 10*a* and 10*b*, owing to the action of the second end portion 12*b* against the stop element 14 of the torsional spring 12, the latter will assume a torsional pretensioning force proportional to the aforementioned angle.

It should be noted that the position of the tubular body 18 on the second hinge pin could be inverted with respect to the torsional spring 12.

In this case the spring would be wound in the opposite direction and would be mounted rotated through 180° with respect to the configuration illustrated in FIG. 7, and the stop element 14 would be positioned close to the second projection 7*b*, while the abutment block 16 could be eliminated since the flexural movements of the second hinge pin 9 would be of a negligible amount.

Figure 14:
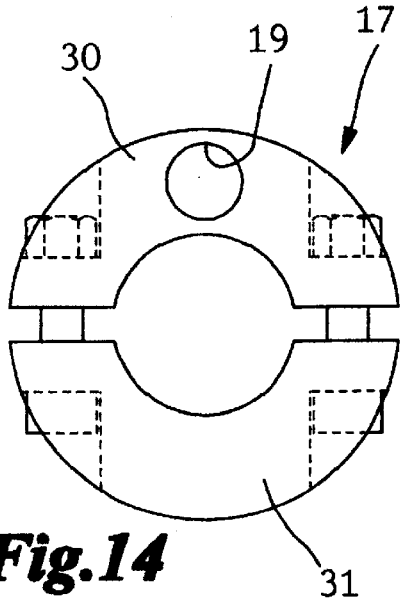
FIG. 14 is a front view of a variant of the element for adjusting the pretensioning force of the spring associated with the plate-like closing element.
Figure 15:
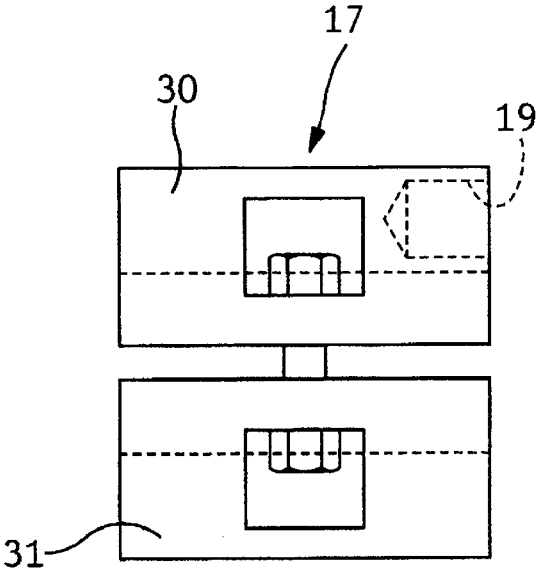
FIG. 15 is a side view of the adjusting element shown in FIG. 14.

As an alternative solution to the above, the adjusting element 17 may be comprised of a pair of shell halves 30, 31, to be engaged by clamping with the hinge pin 9 (see FIGS. 14, 15). At least one of these shell halves is provided with a seating 19 for receiving the first end portion 12*a* of spring 12. In this case too the shell halves can operate close to or spaced apart from the point at which the pin 9 is in engagement with the plate element 5.

It is finally to note that, as a further alternative solution, the adjusting element 17 may be defined by a coupling portion 32 integral with the plate element 5 and adapted for engagement by clamping with the hinge pin 9. In this case provision is made for an engagement seating 33, consisting of a groove for example, which is carried by pin 9 for receiving the first end portion 12*a* of spring 12 in engagement.

Figure 10:
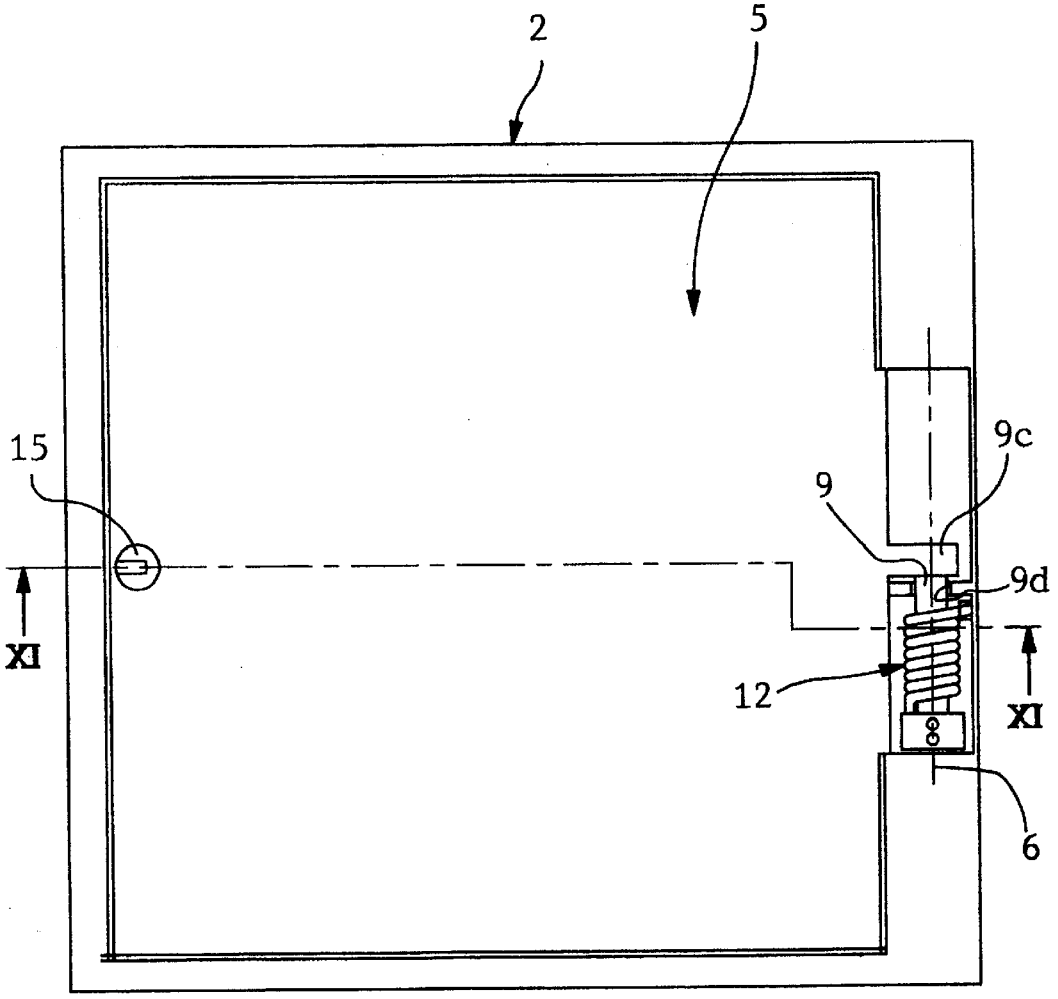
FIGS. 10 and 16 relate to other constructional variants of the device in question.
Figure 12:
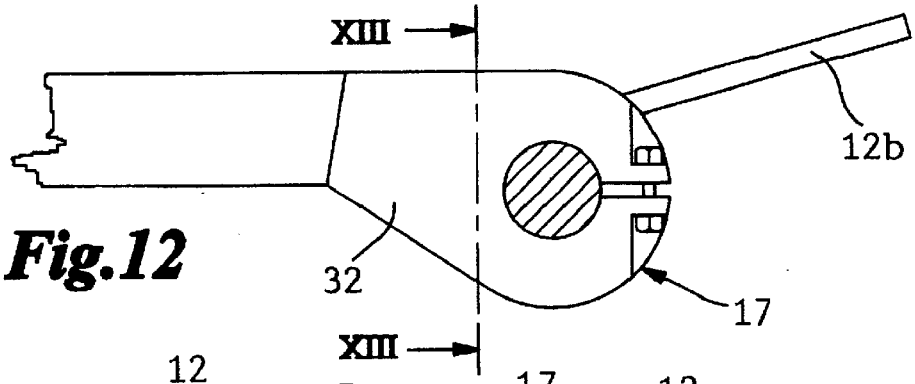
FIG. 12 is a side view showing a constructional detail and a possible fastening system between the plate element and the hinge pin of the plate element itself.
Figure 16:
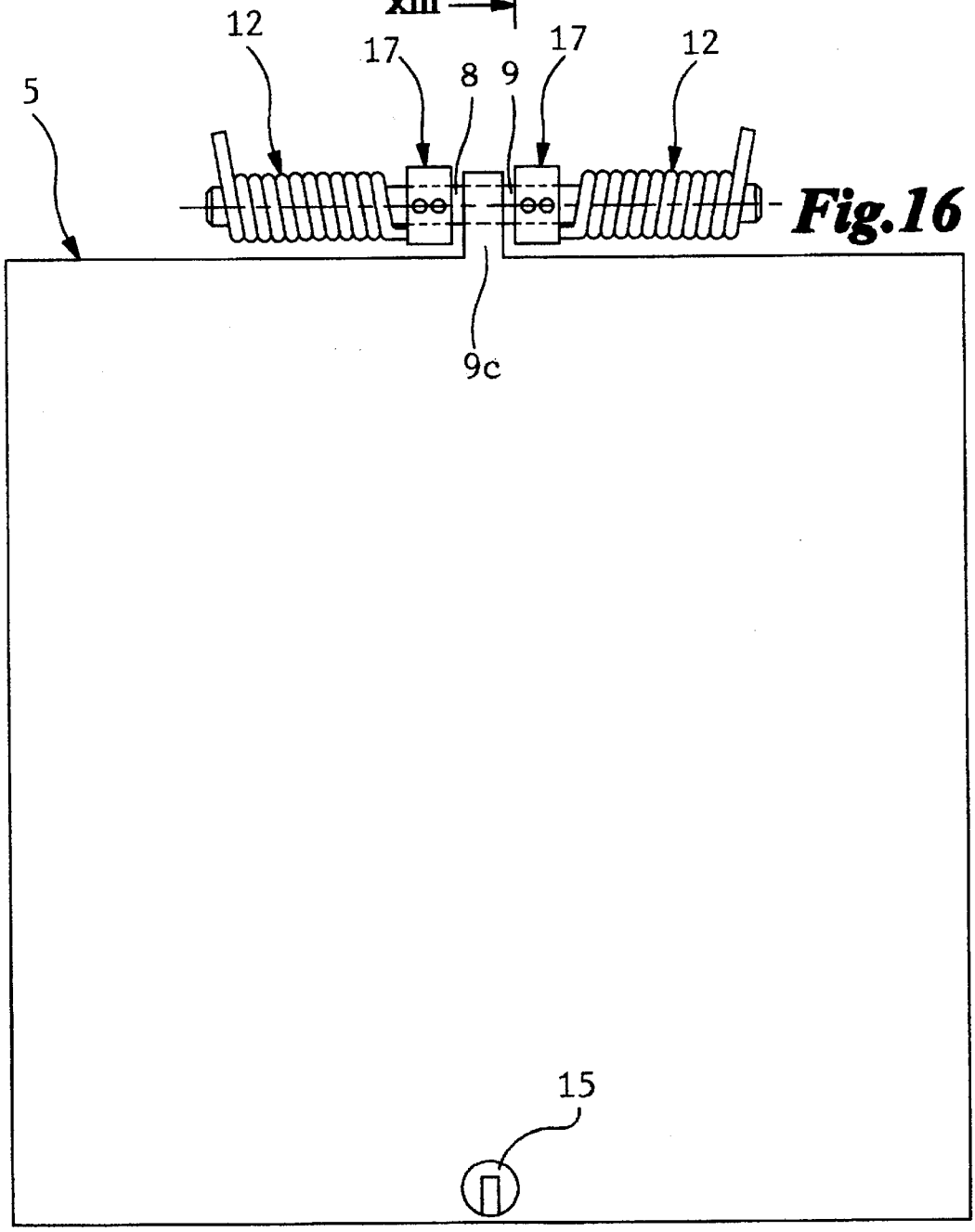

Shown in FIGS. 10 and 16 are further alternative embodiments of the invention. In more detail, FIG. 10 shows a solution providing a single pin 9 fastened to a center projection 9*c* of the plate element 5. FIG. 16 shows a solution providing two hinge pins 8, 9 disposed coaxially in side by side relationship and both mounted on opposite sides of a centre projection 9*c* of the plate element 5.

The spring and adjusting element can be manufactured and can be caused to engage the pins referred to in the embodiments of FIGS. 10 and 16 in the same manner as previously described. Therefore these components will not be herein described again. Obviously in FIGS. 10 and 16 corresponding elements will be allocated identical reference numerals as already used with reference to the other embodiments.

It should be noted that in FIG. 10 the bending stress exerted on the pin 9 is reduced, the force transversal to the hinging axis being the same, because the second end portion 12*b* of spring 12 is released close to the connection zone between the pin and the plate element.

In this case the angular stop means is defined by pin 9 and by the pin rotation seating on the frame and is denoted by 9*d* in FIG. 10.

Operation of the device for closing road wells, which is described above from a mainly structural point of view, is as follows.

Figure 6:
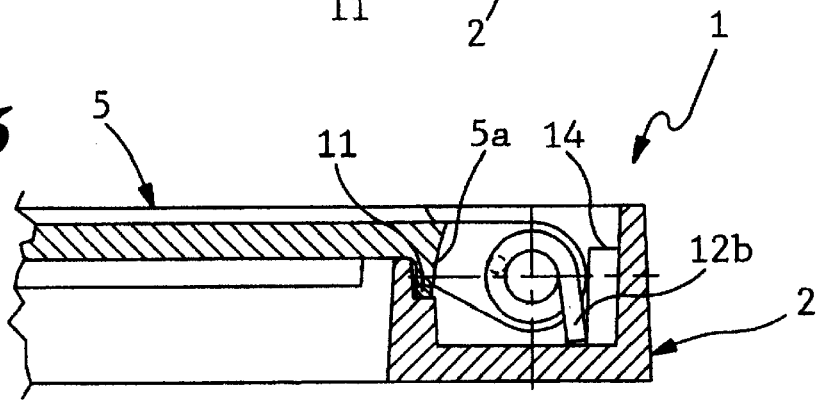

In the closed position the plate element 5 keeps the abutting edge 5*b* in contact with the support zone 2*b* of frame 2 owing to the action of the locking elements 15 opposing the torque exerted by the torsional spring 12 with respect to the hinging axis 6 (see FIG. 6).

When well 1 is required to be opened, it is sufficient to disengage the locking elements 15 and simply raise the plate element 5 with one hand, physically exerting a force which gradually decreases as the cover is raised.

Figure 4:
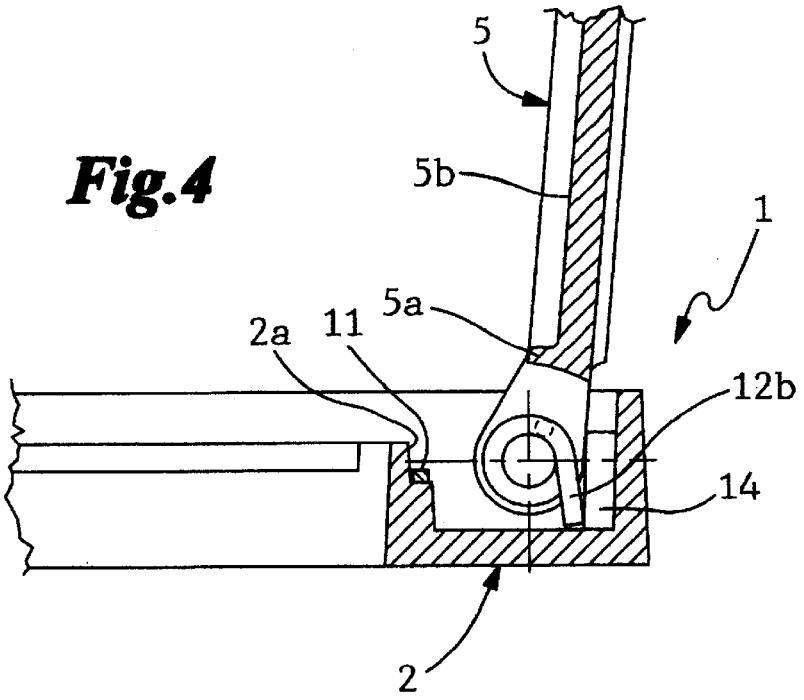
FIGS. 4, 5 and 6 show a cross-section of the closing device according to the invention in the completely open, partially open and closed positions, respectively.
Figure 5:
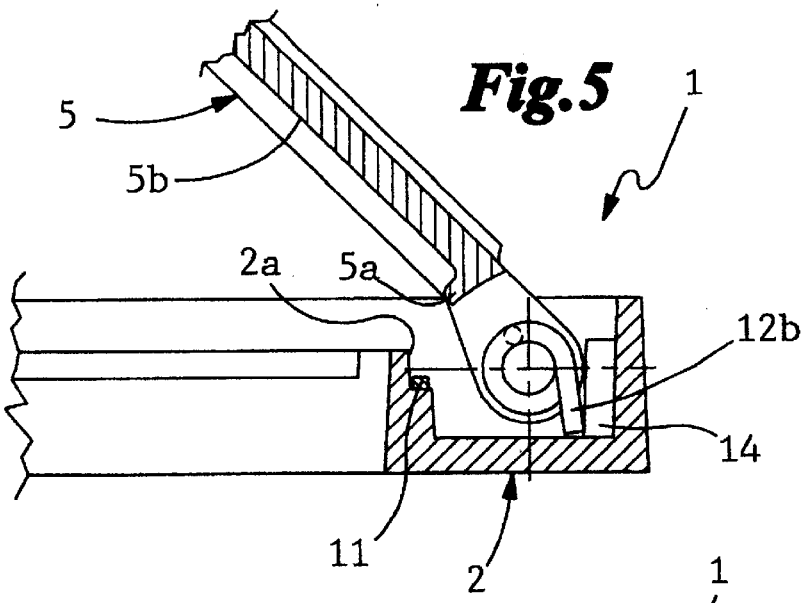

When an equilibrium point is exceeded, for example at the angle of rotation of 60°, the torsional spring 12 automatically completes opening of the well (see FIGS. 4 and 5).

Similarly, during the closing operations, the plate element 5 is pushed towards the frame 2, opposing the increasing moment of the torsional spring 12 which is practically zero in the open position. On approaching the closed position, there is also an increase in the twisting moment exerted by the weight of the plate element with respect to the hinging axis, obviously in a direction opposite to that of the torsional spring so that an operator is never required to exert a great deal of force, provided that the spring is properly gauged.

The invention achieves important advantages.

First of all it is emphasized that the plate-like closing element of the well may be made of grey iron and may also have a large mass since the opening and closing action is performed mainly by a torsional spring and the force required of a person is in any case limited. The entire structure therefore has a low cost owing to the type of material which can be used for the construction thereof and offers all mechanical strength and stability characteristics required in situations subject to high external stresses, also because the plate-like closing element is kept in place not only by its own weight but by the hinge pins and the elements locking it to the frame. Moreover, the opening and closing operations can be performed with a small amount of effort by a single operator and can therefore be easily repeated with great frequency.

The device for closing road wells according to the invention allows one to operate in total safety, since displacements of the plate element are guided by the hinging axis and the weight of said plate element, even when it is considerable, does not constitute any cause of danger since it is always counterbalanced by the action of the torsional spring.

It is advantageous for the spring 12 to discharge its torsional reaction onto the hinge pin or pins which in this way will act as true driving pins. This enables only torques to be transmitted to the plate element, without upwardly directly forces being present that could cause opening of the device 1 in case of breaking of the hinge embodied by said hinge pins.

Since the pin or pins are driving pins, they can be advantageously made of one piece construction with the plate element 5. In addition, due to the fact that there is no upwardly-directed thrust, hinging with frame 2 can be accomplished in such a manner that element 5 is adapted to be drawn out (see FIG. 1, recesses 10*a*, 10*b*). It is further to note that should the pin break, only the spring 12 releasing would occur, the device remaining in any case closed.

The plate element may also have a shape different from that illustrated in the drawings, for example a round or rectangular shape, and the material used may be suitably-reinforced sheet metal.

What is claimed is:

1. A device for closing road wells in vehicle and pedestrian areas comprising:

a support frame (2) defining an access opening (4) for access to a well;

a plate element (5) for closing said access opening (4), said plate element (5) being rotatably engaged with said support frame (2) about a hinging axis (6) so as to be movable between a raised open position and a lowered closed position in which said plate element (5) perimetrically matches said frame (2);

a torsional spring (12) arranged between said plate element (5) and said frame (2), which spring comprises a first end portion (12*a*) operatively connected with said plate element (5) and a second end portion (12*b*) active on said frame (2), said torsional spring (12) being tensioned and exerting a raising force on said plate element when the latter is in said lowered closed position;

at least one hinge pin (9) having an intermediate portion (9*b*) around which said helical spring (12) is wound, said hinge pin (9) being fastened to said plate element (5) along said hinging axis (6);

an element (17) for adjusting the torsional pretensioning force on said torsional spring and comprising a tubular body (18) to be inserted onto said at least one hinge pin (9) the tubular body being provided with a seating (19) for said second end portion (12*b*) of the torsional spring (12) and with at least one threaded transverse hole (20) for receiving a setscrew (21).

2. The device as claimed in claim 1, in which the first end portion (12*a*) of the spring (12) is engaged with said at least one hinge pin, said second end portion (12*b*) acting in abutment on an abutment surface integral with said frame.

3. The device as claimed in claim 2, in which said abutment surface defines on the second spring end portion (12*b*) a constraining reaction (R) having an horizontal component (F1) and a vertical component (F2) directed downwardly.

4. The device as claimed in claim 1, in which said helical spring (12), in the closed position of said plate element (5), exerts a torque on said hinge pin which is at least slightly lower than the torque transmitted to the pin by the weight of the plate-like element (5).

5. A device for closing road wells in vehicle and pedestrian areas comprising:

a support frame (2) defining an access opening (4) for access to a well;

a plate element (5) for closing said access opening (4), said plate element (5) being rotatably engaged with said support frame (2) about a hinging axis (6) so as to be movable between a raised open position and a lowered closed position in which said plate element (5) perimetrically matches said frame (2);

a torsional spring (12) arranged between said plate element (5) and said frame (2), which spring comprises a first end portion (12*a*) operatively connected with said plate element (5) and a second end portion (12*b*) active on said frame (2), said torsional spring (12) being tensioned and exerting a rising force on said plate element when the latter is in said lowered closed position;

at least one hinge pin (9) having an intermediate portion (9*b*) around which said helical spring (12) is wound, said hinge pin (9) being fastened to said plate element (5) along said hinging axis (6);

an element (17) for adjusting the torsional pretensioning force on said torsional spring and comprising a pair of shell-halves to be coupled by clamping with the hinge pin (9), at least one of said shell halves being provided with a seating (19) for the second end portion (12*b*) of the torsional spring (12).

6. The device as claimed in claim 5, in which said second hinge pin (9) is engaged in cantilevered fashion with, said second projection of said plate element and comprises a first end attachment zone (9*a*) and a second free end zone (9*c*), said end zones comprising said intermediate portion (9*b*) between them, said helical spring (12) being wound around said intermediate portion and in which provision is made for an abutment block (16) for said second free end zone (9*c*) which is integral with said support frame (2), for the purpose of withstanding flexural thrust forces generated on said second pin (9) by said helical spring (12).

7. The device as claimed in claim 5, in which the first end portion (12*a*) of the spring (12) is engaged with said at least one hinge pin, said second end portion (12*b*) acting in abutment on an abutment surface integral with said frame.

8. The device as claimed in claim 7, in which said abutment surface defines on the second spring end portion (12*b*) a constraining reaction (R) having an horizontal component (F1) and a vertical component (F2) directed downwardly.

9. The device as claimed in claim 5, in which said helical spring (12), in the closed position of said plate element (5), exerts a torque on said hinge pin which is at least slightly lower than the torque transmitted to the pin by the weight of the plate element (5).

10. A device for closing road wells in vehicle and pedestrian areas comprising:

a support frame (2) defining an access opening (4) for access to a well;

a plate element (5) for closing said access opening (4), said plate element (5) being rotatably engaged with said support frame (2) about a hinging axis (6) so as to be movable between a raised open position and a lowered closed position in which said plate element (5) perimetrically matches said frame (2);

a torsional spring (12) arranged between said plate element (5) and said frame (2), which spring comprises a first end portion (12*a*) operatively connected with said plate element (5) and a second end portion (12*b*) active on said frame (2), said torsional spring (12) being tensioned and exerting a rising force on said plate element when the latter is in said lowered closed position;

at least one hinge pin (9) having an intermediate portion (9*b*) around which said helical spring (12) is wound, said hinge pin (9) being fastened to said plate element (5) along said hinging axis (6);

an element (17) for adjusting the torsional pretensioning force on said torsional spring comprising at least one coupling portion integral with the plate element (5) and adapted to be engaged by clamping with the hinge pin (9), and at least one engagement seating (33) carried by the pin (9) for receiving the first end portion (12*a*) of the helical spring (12).

11. The device as claimed in claim 10, in which the first end portion (12*a*) of the spring (12) is engaged with said at least one hinge pin, said second end portion (12*b*) acting in abutment on an abutment surface integral with said frame.

12. The device as claimed in claim 11, in which said abutment surface defines on the second spring end portion (12*b*) a constraining reaction (R) having an horizontal component (F1) and a vertical component (F2) directed downwardly.

13. The device as claimed in claim 10, in which said helical spring (12), in the closed position of said plate element (5), exerts a torque on said hinge pin which is at least slightly lower than the torque transmitted to the pin by the weight of the plate element (5).

14. A device for closing road wells in vehicle and pedestrian areas comprising:

a support frame (2) defining an access opening (4) for access to a well;

a plate element (5) for closing said access opening (4), said plate element (5) being rotatably engaged with said support frame (2) about a hinging axis (6) so as to be movable between a raised open position and a lowered closed position in which said plate element (5) perimetrically matches said frame (2);

a torsional spring (12) arranged between said plate element (5) and said frame (2), which spring comprises a first end portion (12*a*) operatively connected with said plate element (5) and a second end portion (12*b*) active on said frame (2), said torsional spring (12) being tensioned and exerting a raising force on said plate element when the latter is in said lowered closed position;

at least two hinge pins (8, 9) located at a distance from one another, aligned along said hinging axis (6) and fastened to the plate element (5), said hinge pins (8, 9) comprising a first pin of smaller length (8) and a second pin of greater length (9) having said intermediate portion (9*b*), said plate element (5) periferically having a pair of projections (7*a*, 7*b*) comprising a first projection (7*a*) and a second projection (7*b*) designed to engage with said first smaller pin (8) and said second larger pin (9) respectively, said second projection (7*b*) having a seat (13) formed therein for fastening said first end portion (12*a*) of said helical spring.

15. The device as claimed in claim 14, in which two hinge pins are fastened to the plate element (5), said pins being disposed coaxially in side by side relationship and each of said pins being provided with a respective helical spring and a respective adjusting element.

16. The device as claimed in claim 15, in which the plate element has a (center) projection (9*c*) to which said at least one pin is fastened.

17. The device as claimed in claim 14, in which the first end portion (12*a*) of the spring (12) is engaged with said at least one hinge pin, said second end portion (12*b*) acting in abutment on an abutment surface integral with said frame.

18. The device as claimed in claim 17, in which said abutment surface defines on the second spring end portion (12*b*) a constraining reaction (R) having an horizontal component (F1) and a vertical component (F2) directed downwardly.

19. The device as claimed in claim 14, in which said helical spring (12), in the closed position of said plate element (5), exerts a torque on said hinge pin which is at least slightly lower than the torque transmitted to the pin by the weight of the plate element (5).

* * * * *